US009657424B2

(12) United States Patent
Kim

(10) Patent No.: US 9,657,424 B2
(45) Date of Patent: May 23, 2017

(54) WASHING MACHINE AND BUBBLE GENERATING APPARATUS THEREOF

(71) Applicant: Dongbu Daewoo Electronics Corporation, Seoul (KR)

(72) Inventor: Hye Ung Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 238 days.

(21) Appl. No.: 14/175,930

(22) Filed: Feb. 7, 2014

(65) Prior Publication Data

US 2015/0176171 A1 Jun. 25, 2015

(30) Foreign Application Priority Data

Dec. 23, 2013 (KR) ..... 10-2013-0161104

(51) Int. Cl.
*D06F 35/00* (2006.01)
*D06F 17/12* (2006.01)
*D06F 37/30* (2006.01)

(52) U.S. Cl.
CPC ..... *D06F 35/002* (2013.01); *D06F 17/12* (2013.01); *D06F 37/30* (2013.01)

(58) Field of Classification Search
CPC ..... D06F 35/002; D06F 17/12
See application file for complete search history.

(56) References Cited

U.S. PATENT DOCUMENTS 5,253,380 A * 10/1993 Lim ..... D06F 17/12 68/183
5,653,129 A 8/1997 Jang
5,771,719 A * 6/1998 Moon ..... D06F 17/06 68/183
6,881,035 B1 * 4/2005 Paulsen ..... F01D 5/14 416/183
2004/0103695 A1 * 6/2004 Lim ..... D06F 37/30 68/12.16
2007/0116576 A1 * 5/2007 Chang ..... F04D 29/281 416/228
2008/0250823 A1 * 10/2008 Oak ..... D06F 35/002 68/5 C
2012/0102661 A1 * 5/2012 Kim ..... D06F 17/06 8/137
2012/0159716 A1 6/2012 Lee
(Continued)

FOREIGN PATENT DOCUMENTS

CN 2255442 Y 6/1997
KR 20-1998-0031284 U 8/1998
KR 1999-0028246 7/1999
(Continued)

OTHER PUBLICATIONS

Machine translation of KR 20-1998-0031284 U, no date.*
(Continued)

*Primary Examiner* — Joseph L Perrin

(57) ABSTRACT

A bubble generating apparatus may include a driving shaft that rotates a drum, a rotatable fan on the driving shaft to generate an air flow as the fan rotates, a housing having a receiving space including or enclosing the rotatable fan, and an air tube connecting a stationary tub in the drum and the housing, configured to guide air from the housing to the drum.

13 Claims, 5 Drawing Sheets

(56) References Cited

U.S. PATENT DOCUMENTS

2014/0205459 A1* 7/2014 Dobie ..... F04D 29/023
416/195

FOREIGN PATENT DOCUMENTS

KR 10-2000-0003780 A 1/2000
KR 10-2007-0098213 A 10/2007

OTHER PUBLICATIONS

Abstract of KR 1999-0028246; Jul. 15, 1999; http://engpat.kipris.or.kr.
Chinese Office Action dated Jan. 12, 2017 issued in corresponding Chinese Patent Application No. 201410048041.8 and English translation thereof.

* cited by examiner

WASHING MACHINE AND BUBBLE GENERATING APPARATUS THEREOF

CROSS-REFERENCE TO RELATED APPLICATIONS

This application is based on and claims priority from Korean Patent Application No. 10-2013-0161104, filed on Dec. 23, 2013, the disclosure of which is incorporated herein in its entirety by reference.

TECHNICAL FIELD

The present disclosure relates to a washing machine and a bubble generating apparatus thereof, and more particularly, to a washing machine and a bubble generating apparatus thereof, capable of providing bubbles to a stationary tub by using a driving shaft that rotates a washing tub.

BACKGROUND

In general, a washing machine refers to a mechanical apparatus that cleans and quickly washes contaminants from dirty laundry such as clothes or bedclothes using a detergent emulsion and frictional action of washing water that flows from rotational motion and/or impact action with the laundry, and the like.

In accordance with a washing manner, the washing machine may be classified into (i) a pulsator type (e.g., a rotating laundry plate type) washing machine that uses a water current formed by rotating a rotating wing or pulsator at a bottom of the tub, (ii) an agitator type (e.g., rod washing type) washing machine that washes the laundry by rotating a washing rod or cylinder having a rotating wing at a center of a tub, and (iii) a drum type (e.g., cylinder type) washing machine that washes the laundry using a force that occurs when the laundry falls in the drum by rotating the drum.

In recent years, a washing machine including a bubble generating apparatus that provides bubbles and/or foam to the washing tub has been proposed to enhance washing efficiency. When bubbles generated in the bubble generating apparatus are introduced to the washing tub, since the bubbles burst due to contact with the laundry, thereby impacting the laundry, contaminants attached or adhered to the laundry may be effectively removed.

Since conventional bubble generating apparatus and conventional controllers for controlling the bubble generating apparatus are expensive, the cost of washing machine production increases.

In addition, when the bubble discharging pressure of the bubble generating apparatus is weak due to an insufficient amount of bubbles supplied to the washing tub, the washing effect of the laundry by the bubbles may be reduced.

A conventional washing machine may be disclosed in Korean Utility Model Application Publication No. 1999-0028246, published on Jul. 15, 1999.

SUMMARY

The present disclosure provides a washing machine and a bubble generating apparatus thereof, capable of generating bubbles in a stationary tub using a driving shaft that rotates a washing tub (e.g., drum).

Exemplary embodiments of the present disclosure provide a bubble (e.g., bubble, micro bubble and/or foam) generating apparatus including a driving shaft that rotates a drum, a rotatable fan (e.g., a propeller or rotatable plurality of blades) on or connected to the driving shaft (e.g., to circulate or flow air as the fan rotates), a housing having a receiving space that includes and/or encompasses the rotatable fan, and an air tube connecting a stationary tub and the housing, configured to guide air from the housing to the drum. The drum is enclosed by the stationary tub, which is configured to hold water and receive the air flow from the fan.

Other exemplary embodiments of the present disclosure provide a washing machine including a case forming an exterior of the washing machine; a stationary tub in the case configured to contain water; a drum in the stationary tub; a motor rotating the drum; and a bubble generating apparatus configured to supply air to the stationary tub using a shaft of the motor, wherein the bubble generating apparatus includes a rotatable fan on or connected to the driving shaft (e.g., forms an air flow as the fan rotates), a housing having a receiving space that includes the fan, and an air tube connecting a stationary tub and the housing, configured to guide air from the housing to the drum.

Embodiments of the present disclosure may generate bubbles in the stationary tub using a driving shaft (e.g., by rotating the drum).

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
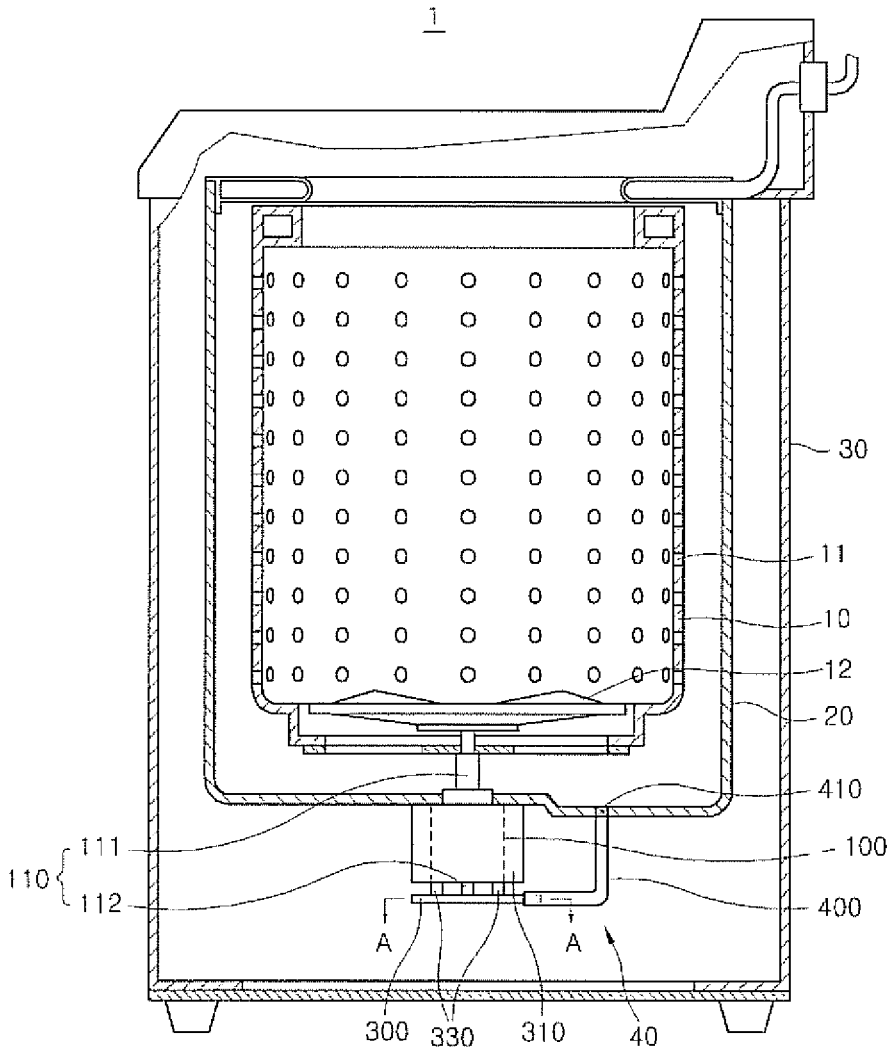
FIG. 1 is a partial side sectional view illustrating an exemplary bubble generating apparatus in a washing machine according to exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Exemplary embodiments of the present disclosure will be described more fully hereinafter with reference to the accompanying drawings, in which the exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

FIG. 1 is a partial side sectional view illustrating an exemplary bubble generating apparatus in a washing machine according to exemplary embodiments of the present disclosure.

As illustrated in FIG. 1, a washing machine 1 according to exemplary embodiments of the present disclosure may provide bubbles inside a stationary tub 20 by using a driving shaft 110 that rotates a drum 10.

In the exemplary embodiments, a pulsator type washing machine, in which a door is on an upper section thereof, will be exemplarily described as the washing machine 1. The washing machine 1 may be also an agitator type washing machine or a drum type washing machine.

The washing machine 1 may include a case or external housing 30, the stationary tub 20, the drum 10, a motor 100, and a bubble generating apparatus 40.

The case 30 forms an exterior of the washing machine 1, and may have a substantially hexahedron (e.g., cubic or 6-sided block) shape. The case 30 may have front and rear panels having substantially identical dimensions, and side panels having substantially identical dimensions. The stationary tub 20, the motor 100 and the bubble generating apparatus 40 may be in the case 30.

The stationary tub 20 is a receiving body capable of receiving water, and may have a substantially cylindrical shape. The stationary tub 20 may receive the water from a water supply valve (not illustrated), and drain the water to the outside of the case 30 through a drain hole using a pump (not illustrated). The drum 10 may be rotatable, and installed completely within the stationary tub 20. The stationary tub 20 may correspond to a tub of a drum type washing machine.

The drum 10 may have a cylindrical body having a plurality of water communication holes. The drum 10 may be rotated inside the stationary tub 20 by the driving shaft 110 of the motor 100. A pulsator 12 or other agitator may be in the drum 10 and may be semi-rotated or fully rotated by the driving shaft 110. The drum 10 corresponds to a drum or washing tub of a drum type washing machine.

The motor 100 may be at or below a lowermost surface or end of the stationary tub 20. The motor 100 may be connected to the bubble generating apparatus 40 and to the drum 10 by the driving shaft 110.

The driving shaft 110 may include a first driving shaft 111 in one direction from the motor 100, and a second driving shaft 112 that is concentric with the first driving shaft 111 and in another direction from the motor 100. The first driving shaft 111 and the second driving shaft 112 may be simultaneously rotated by the motor 100 and may be a single, integral shaft. The first driving shaft 111 may rotate the drum 10 and the pulsator 12, and the second driving shaft 112 may rotate a fan 200. The exemplary embodiments illustrate that the first driving shaft 111 is on or over the motor 100, and the second driving shaft 112 is under or below the motor 100. Alternatively, a clutch in the motor 100 can operate the first shaft 111 and the second shaft 112 at different speeds, and at the same or different times.

Figure 2:
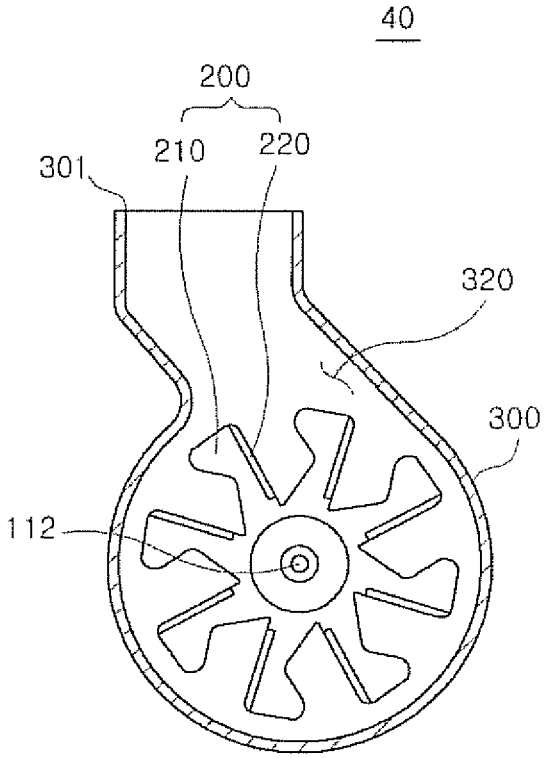
FIG. 2 is a cross-sectional view taken along line "A-A" of FIG. 1.

FIG. 2 is a cross-sectional view taken along line "A-A" of FIG. 1.

As illustrated in FIGS. 1 and 2, the bubble generating apparatus 40 according to exemplary embodiments of the present disclosure may provide bubbles (e.g., bubbles, micro bubbles and/or foam) to the stationary tub 20 by rotating the driving shaft 110 of the motor 100 and flowing air into the stationary tub 20 (e.g., through a screen, mesh, or other surface with small holes therein).

The bubble generating apparatus 40 may include the fan 200, a housing 300, and an air tube 400.

The fan 200 may be substantially rotated by power transmitted from the motor 100, and may be directly on the second driving shaft 112 or on a separate rotating shaft connected to the second driving shaft 112. The exemplary embodiments illustrate that the second driving shaft 112 extends into the housing 300, and the fan 200 is on the second driving shaft 112.

The fan 200 may be rotatable, and contained within a receiving space 320 of the housing 300, and may rotate simultaneously with the driving shaft 110. As the fan 200 rotates, air passes through one or more holes or openings (not illustrated) in the housing 300 and passes through to a discharge outlet 301 in the housing 300.

The fan 200 may include a main blade 210 and a sub-blade 220. The main blade 210 is connected to an end of the second driving shaft 112 and may radially extend from the second driving shaft 112. The sub-blade 220 may be vertically formed at an end or edge of the main blade 210. The vertical sub-blade 220 may induce air in the receiving space 320 toward the discharge outlet 301 by the rotation of the main blade 210.

The fan may include at least four main blades 210, which may be branched into at least four portions. While the exemplary embodiment(s) illustrate that the fan is branched radially into eight main blades 210, the spirit of the present disclosure is not limited to a particular number of main blades 210.

The housing 300 may be on or a connected to a protector 310 using a coupling frame 330. The housing 300 generally encloses and/or protects the motor 100. The housing 300 may have the discharge outlet 301 through which the air is discharged. The receiving space 320 having the fan 200 therein may be in the housing 300. The receiving space 320 may include a flow passage through which the air flows.

The air tube 400 may guide the air from the discharge outlet 301 to the stationary tub 20. For this operation, the air tube 400 connects the stationary tub 20 and the housing 300.

Particularly, the air tube 400 may be connected to the discharge outlet 301 and a bottom surface of the stationary tub 20. When water (and, optionally, detergent) are in the drum 10, the air in the air tube 400 may be converted into air bubbles when supplied to the drum 10.

An outlet of the air tube 400 may be connected to a lowermost surface of the stationary tub 20 through a check valve or other one-way valve 410 that allows a flow in one direction, and thus the water in the tub 20 may be prevented from flowing into the air tube 400.

Operations of the embodiments having the above-described configurations will be described.

When water is supplied to the stationary tub 20 and the driving shaft 110 rotates, the fan 200 may rotate from rotation of the driving shaft 110.

The air in the housing 300 flows to the discharge outlet 301 of the housing 300 by the rotation of the fan 200, and then may be introduced through the bottom surface of the stationary tub 20 and the air tube 400. In the stationary tub 20, the air may take the form of bubbles (e.g., micro bubbles and/or foam). Micro bubbles may be air bubbles having a diameter of 50 μm or less, a size or diameter distribution in which 90% or more of the bubbles have a diameter of 50 μm or less. For example, micro bubbles may have a size or diameter distribution in which 95% or 98% of the bubbles have a diameter of 50 μm, 40 μm, 30 μm or less. In general, micro bubbles do not necessarily burst or disappear by friction or rubbing, although they can burst upon contact with clothing or fabric. Micro bubbles generally have a very high surface energy to surface area ratio, and they generally release more mechanical energy per unit volume larger than air bubbles, which can facilitate cleaning and improve washing efficiency.

Thus, the bubble generating apparatus 40 may increase the discharge pressure of the air using the driving force of the driving shaft 110, thus increasing the amount of the bubbles supplied to the drum 10. As a result, the washing effect of the washing machine may be enhanced using the bubbles. Furthermore, the present bubble generating apparatus 40 is less expensive than a bubble generating apparatus using electrical force or a controller.

Figure 3:
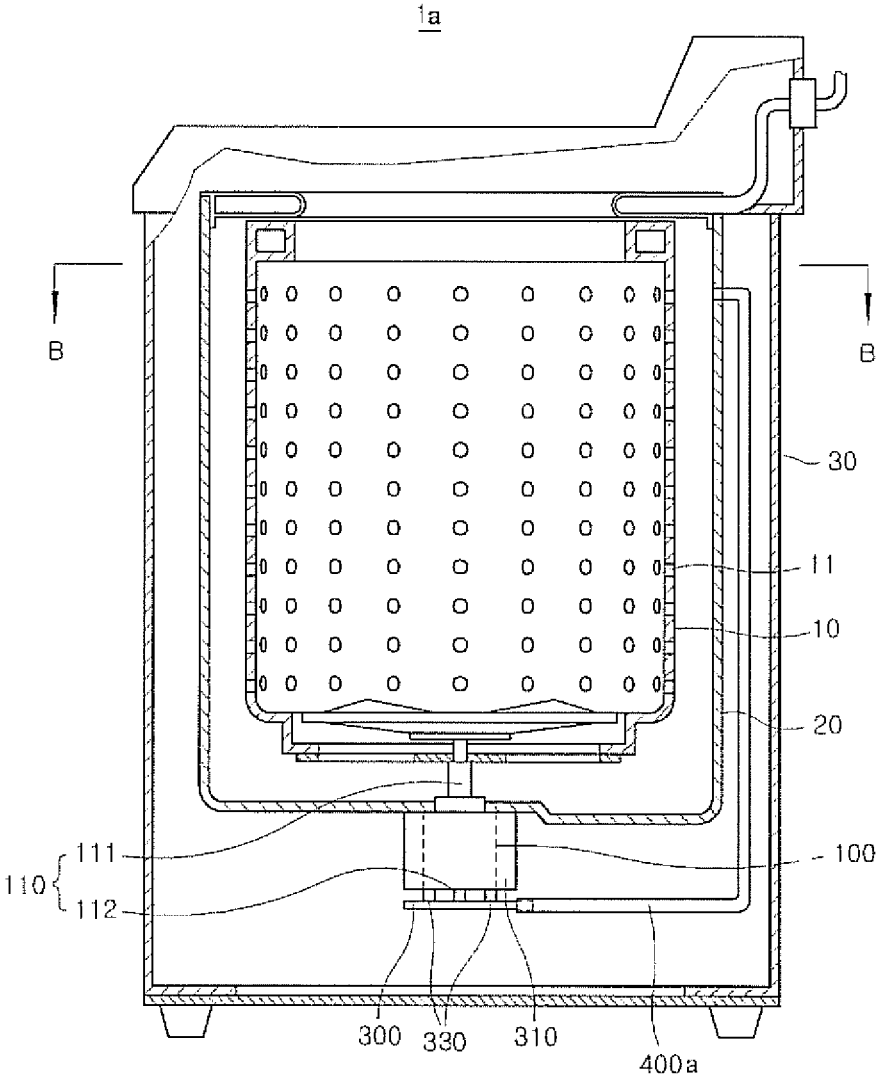
FIG. 3 is a partial side sectional view illustrating an exemplary bubble generating apparatus in a washing machine according to other exemplary embodiments of the present disclosure.
Figure 4:
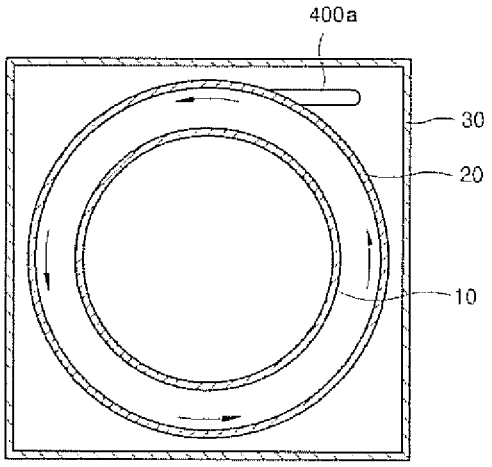
FIG. 4 is a cross-sectional view taken along line "B-B" of FIG. 3.

FIG. 3 is a cross-sectional view illustrating an exemplary bubble generating apparatus in a washing machine according to other exemplary embodiments of the present disclosure, and FIG. 4 is a sectional view taken along line "B-B" of FIG. 3.

As illustrated in FIGS. 3 and 4, in a washing machine 1*a* according to other exemplary embodiments of the present disclosure, an air tube 400*a* may discharge air from the discharge outlet 301 through an upper section or surface of the stationary tub 20. The location that the air tube 400*a* discharges the air may be higher than the highest possible level of water in the stationary tub 20. When water is removed from the laundry in the drum 10, since the air from the air tube 400*a* may flow on to and/or through the laundry in the drum 10, water may be removed from the laundry, and/or the laundry may be dried by the air.

Also, a discharge outlet of the air tube 400*a* may be connected to the stationary tub 20 such that the air may be tangentially or horizontally discharged into the stationary tub 20. Since the air from the air tube 400*a* may move in the form of a vortex along an inner circumference of the stationary tub 20, it is possible to effectively remove water from and/or dry the laundry. Compared with air vertically discharged to or along the outer circumference of the stationary tub 20, air discharged in the tangential and/or horizontal direction of the stationary tub 20 may rapidly move along the inner circumference of the stationary tub 20, so that the laundry in the drum 10 may be effectively dried.

The air discharged through the air tube 400*a* can be heated by the motor 100. Alternatively, a separate resistive or ohmic heater can be provided below the housing 300 to heat the air. Openings in the top of the housing 300 can pull air from the vicinity of the motor 100, and openings in the bottom of the housing 300 can pull air across the heater, before discharging the air through the opening 301 and into the air tube 400.

Figure 5:
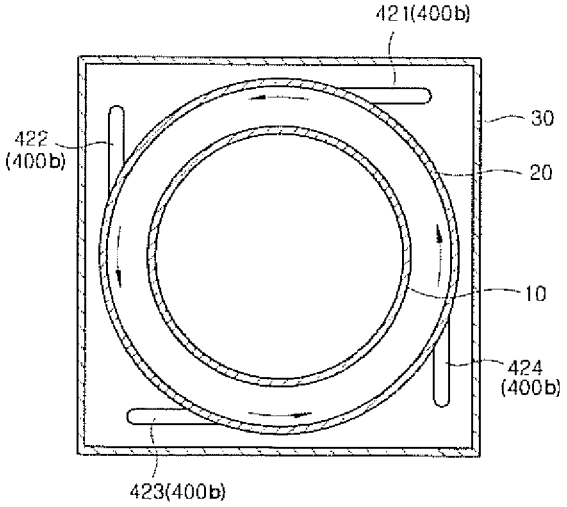
FIG. 5 is a cross-sectional view illustrating a connector between an air tube and a water storage tank in the exemplary bubble generating apparatus of the washing machine of FIG. 4.

FIG. 5 is a cross-sectional view illustrating an alternate connection structure between one or more air tubes and a water storage tank (e.g., tub) in the exemplary bubble generating apparatus and/or washing machine of FIG. 4.

As illustrated in FIG. 5, a plurality of air tubes 400*b* may be connected in tangential and/or horizontal directions to an upper section or surface of the stationary tub 20.

The air tube(s) 400*b* may be branched and/or plural, and be connected to the upper section or surface of the stationary tub 20. The plurality of air tubes 400*b* may be spaced apart or separated by a predetermined distance, angle or arc along the upper section or surface of the stationary tub 20, and configured to discharge air in a clockwise or counterclockwise direction.

In exemplary embodiments, the air tube(s) 400*b* may include a first air tube 421, a second air tube 422, a third air tube 423, and a fourth air tube 424 arranged at intervals of 90 degrees along the stationary tub 20. Thus, the air may smoothly rotate along the inner circumference of the stationary tub 20 to rapidly remove water from and/or dry the laundry in the drum 10.

Operations of exemplary embodiments having the above-described configurations will be described.

When the washing water is drained from the stationary tub 20 and the driving shaft 110 rotates, the fan 200 may be rotated by the driving shaft 110.

The air inside the housing 300 flows to the discharge outlet 301 of the housing 300 by the rotation of the fan 200, and then the air may enter the upper section of the stationary tub 20 through the air tube(s) 400.

Figure 6:
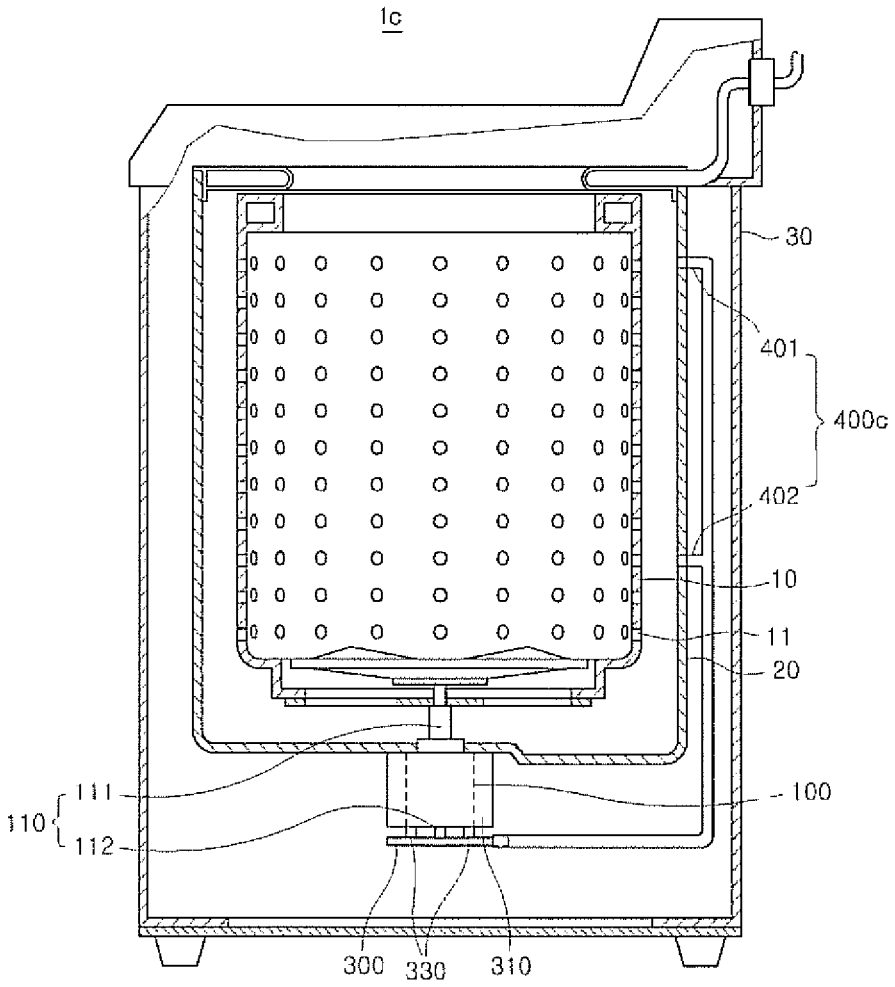
FIG. 6 is a partial side sectional view illustrating an exemplary bubble generating apparatus in a washing machine according to other exemplary embodiments of the present disclosure.

FIG. 6 is a cross-sectional view illustrating an exemplary bubble generating apparatus and washing machine according to other exemplary embodiments of the present disclosure.

As illustrated in FIG. 6, in a washing machine 1*c* according to other exemplary embodiments of the present disclosure, an air tube 400*c* may include a lower branch 402 connected to a lower side, section or surface of the stationary tub 20, and an upper branch 401 connected to an upper side, section, or surface of the stationary tub 20.

Outlets of the upper branch 401 and the lower branch tube 402 may be tangentially or horizontally connected along the stationary tub 20 to a lower section or surface and an upper section or surface of the stationary tub 20, respectively, and an inlet of the air tube 400*c* may be connected to the discharge outlet 301 of the housing 300.

Thus, since the air is from the upper section and the lower section of the stationary tub 20 through the upper branch 401 and the lower branch 402, the laundry at/in an upper section and a lower section of the drum 10 may remove water from and/or be rapidly dried. Alternatively, the air tube 403 can include (i) a 3-way valve in a horizontal portion (e.g., near the housing 300), and (ii) a separate air tube connected to the lowermost surface of the tub 20, enabling both bubble making and drying, separately or simultaneously.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A bubble generating apparatus of a washing machine, comprising:

a driving shaft that rotates a drum;

a rotatable fan on the driving shaft to generate an air flow;

a housing having a receiving space including or enclosing the rotatable fan; and an air tube connecting a stationary tub in the drum and a discharge outlet of the housing, configured to guide air from the housing to the drum, wherein the air tube is connected to the discharge outlet of the housing and wherein the air tube comprises an upper branch and a lower branch, said upper branch and lower branch each having a discharge outlet tangentially or horizontally connected along the stationary tub, wherein the upper branch is connected to an upper section of the stationary tub configured to blow air to the laundry in the drum, and wherein the lower branch is connected to a lower section of the stationary tub configured to generate bubbles in the drum.

2. The apparatus of claim 1, wherein the driving shaft is connected to a motor configured to rotate the drum.

3. The apparatus of claim 1, wherein the driving shaft comprises a first driving shaft in one direction from the motor, and a second driving shaft that is concentric with the first driving shaft and in another direction from the motor.

4. The apparatus of claim 3, wherein the motor simultaneously rotates the first driving shaft and the second driving shaft, and the first and second driving shafts are integral.

5. The apparatus of claim 3, wherein the first driving shaft rotates the drum and an agitator in the drum, and the second driving shaft rotates a fan.

6. The apparatus of claim 1, wherein the housing is on or under a protector configured to enclose and protect the motor.

7. The apparatus of claim 1, wherein the fan comprises:

one or more main blades radially extending from an end of the driving shaft; and one or more vertical sub-blades at an end or edge of the main blade(s).

8. The apparatus of claim 7, wherein the sub-blade(s) are configured to induce air in the receiving space toward a discharge outlet of the housing.

9. The apparatus of claim 8, wherein the fan comprises at least four main blades.

10. A washing machine comprising:

a case forming an exterior of the washing machine;

a stationary tub in the case configured to contain water;

a drum in the stationary tub;

a motor configured to rotate the drum; and a bubble generating apparatus configured to supply air to the stationary tub using a driving shaft of the motor, wherein the bubble generating apparatus comprises a rotatable fan on or connected to the driving shaft configured to generate air flow as the fan rotates, a housing having a receiving space that includes the rotatable fan, and an air tube connecting the stationary tub and a discharge outlet of the housing, configured to guide air from the housing to the drum, wherein the air tube is connected to the discharge outlet of the housing wherein the air tube comprises an upper branch and a lower branch, said upper branch and lower branch each having a discharge outlet tangentially or horizontally connected along the stationary tub, wherein the upper branch is connected to an upper section of the stationary tub configured to blow air to the laundry in the drum, and wherein the lower branch is connected to a lower section of the stationary tub configured to generate bubbles in the drum.

11. The washing machine of claim 10, wherein the air tube comprises a plurality of branches connected to the upper section of the stationary tub.

12. The washing machine of claim 11, wherein the plurality of branches are spaced apart or separated by a predetermined distance, angle or arc along the upper section of the stationary tub.

13. The washing machine of claim 10, wherein the bubble generating apparatus is further configured to provide air through a lowermost surface of the tub and form bubbles in the water in the tub.

* * * * *